US006355159B1

(12) United States Patent
Myers et al.

(10) Patent No.: US 6,355,159 B1
(45) Date of Patent: Mar. 12, 2002

(54) DISSOLUTION AND STABILIZATION OF THERMALLY CONVERTED BITUMEN

(75) Inventors: Ronald Damian Myers; Mainak Ghosh; Michelle A. Young; Tapan Chakrabarty, all of Calgary; Bruce M. Sankey, Okanagan Centre, all of (CA); Irwin Andrew Wiehe, Gladstone, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/632,993

(22) Filed: Aug. 4, 2000

(51) Int. Cl.[7] ..... C10G 47/04; C10G 47/02; C07C 7/20

(52) U.S. Cl. ..... 208/108; 208/14; 208/109; 208/110; 208/111.3; 208/112; 208/95; 208/370; 585/1; 585/899

(58) Field of Search ..... 208/14, 108, 109, 208/110, 111.3, 112, 95, 370; 585/1, 899

(56) References Cited

U.S. PATENT DOCUMENTS

| | | | | | |
|---|---|---|---|---|---|
| 3,527,692 | A | * | 9/1970 | Titus | 208/211 |
| 4,485,004 | A | * | 11/1984 | Fisher et al. | 208/112 |
| 4,933,067 | A | * | 6/1990 | Rankel | 208/45 |
| 5,069,775 | A | | 12/1991 | Grosboll | 208/108 |
| 5,236,577 | A | * | 8/1993 | Tipman et al. | 208/390 |
| 5,807,478 | A | | 9/1998 | Myers et al. | 208/370 |
| 5,871,634 | A | | 2/1999 | Wiehe et al. | 208/48 R |
| 5,997,723 | A | | 12/1999 | Wiehe et al. | 208/48 R |
| 6,096,192 | A | * | 8/2000 | Myers et al. | 208/108 |

* cited by examiner

*Primary Examiner*—Nadine Preisch
(74) *Attorney, Agent, or Firm*—Joseph J. Allocca

(57) ABSTRACT

A heavy hydrocarbon is rendered pipelineable by hydroconverting the heavy hydrocarbon under conditions sufficient to obtain a product oil of lowered viscosity and an API gravity suitable for pipelining and thereafter adding a diluent modified hydrocarbon to the product oil in an amount sufficient to stabilize the product oil against asphaltene phase separation and when phase separated asphaltene is present to dissolve the phase separated asphaltenes.

7 Claims, No Drawings

DISSOLUTION AND STABILIZATION OF THERMALLY CONVERTED BITUMEN

FIELD OF THE INVENTION

This invention relates to the modification of heavy hydrocarbons such as bitumen from oil sands to render them pipelineable. More specifically, this invention relates to the preparation of a stabilized, blended oil having a viscosity and density suitable for transporting through a pipeline.

BACKGROUND OF THE INVENTION

With the decrease in the reserves of conventional crude oils, particularly in North America, there is an increasing demand for heavy hydrocarbons such as those extracted from oil sands. These heavy hydrocarbons, however, are typically located in geographical regions far removed from where their demand exists and where there is limited refinery capacity. Consequently, these heavy hydrocarbons must be transported through a pipeline to a point of use.

In order to transport these heavy hydrocarbons, the bitumen typically is mixed with a diluent such as natural gas condensate to reduce the viscosity and density of the bitumen to render it suitable for pipelining.

Unfortunately, the supply of natural gas condensate may not keep pace with the continuing growth in the production and use of such heavy hydrocarbons. Therefore, there is a need for improvements on reducing the viscosity and density of bitumen to render it pipelineable.

In U.S. Pat. No. 5,069,775 a process is disclosed in which a portion of a heavy hydrocarbon is hydrotreated to form a light oil. The light oil is then blended with the remainder of the crude to produce crude oil of reduced density and viscosity. This process requires extensive conversion of the hydrotreated portion in order to obtain a sufficiently light oil for blending with the untreated portion if pipeline specifications are to be met.

An alternate approach is to subject a heavy hydrocarbon such as bitumen to slurry hydroprocessing under conditions sufficient to lower the viscosity and specific gravity of the hydrocarbon to an appropriate range for pipelining. Experience has shown, however, that under these conditions the chemistry and solubility of the asphaltenes is sufficiently changed that the asphaltenes may phase separate in the pipeline or when the product oil comes in contact with other oils, both of which events are highly undesirable.

Thus, there remains a need for an improved method for rendering heavy hydrocarbons pipelineable while using reduced amounts of diluent.

It is also desirable to provide a process that decreases the viscosity and specific gravity of the crude at the lowest possible cost.

SUMMARY OF THE INVENTION

Accordingly, in one embodiment of this invention, there is provided a method for rendering a heavy hydrocarbon pipelineable which comprises processing a heavy hydrocarbon under hydroconversion conditions sufficient to obtain a product oil with a reduced viscosity and an API gravity suitable for pipelining. Thereafter, a diluent modified heavy hydrocarbon such as a diluent modified bitumen is added to the product oil in an amount sufficient to stabilize the product oil against asphaltene phase separation, and when phase separated asphaltene is present, to dissolve the phase separated asphaltenes.

DETAILED DESCRIPTION OF THE INVENTION

The heavy hydrocarbon materials suitable for the use in the practice of the present invention are those which contain a substantial portion, i.e., greater than 35 vol % of material boiling above 525° C., equivalent atmospheric boiling point. Indeed, of particular interest are the heavy hydrocarbon oils extracted from oil sands, most particularly Athabasca and Cold Lake oil sands. Typically, such heavy hydrocarbons at 40° C. have a viscosity exceeding 5,000 centistokes and an API gravity at 15° C. of less than about 10.5°.

According to the invention, the heavy hydrocarbon is first subjected to a "mild-hydroconversion" process. The term "mild-hydroconversion" is used herein to designate a catalytic process conducted in the presence of hydrogen in which about 40% to about 60% of the 525° C.+ fraction of the heavy hydrocarbon is converted to a product oil of lowered viscosity. Preferably the mild-conversion is conducted at temperatures ranging between about 400° C. to about 450° C. and hydrogen partial pressures ranging between about 700 psig to about 1500 psig for a time sufficient to lower the viscosity of the heavy hydrocarbon at 40° C. within the range of about 30 to 60 cSt, and preferably within 40 to 50 cSt and the API gravity at 15° C. within the range of about 17° to 21°.

Among suitable catalysts for use in the mild conversion step of the present invention, mention is made of a molybdenum containing catalyst such as the phosphomolybdic acid disclosed in U.S. Pat. No. 5,620,591 incorporated herein by reference, or fly ash catalyst derived from bitumen coke such as that disclosed in U.S. Pat. 5,807,478 also incorporated herein by reference. Typically, the catalyst is added to the heavy hydrocarbon in the range of about 0.002 wt % to about 7 wt % based on the weight of heavy hydrocarbon, depending on the catalyst selected.

In a typical process, a heavy fraction of the hydroconverted hydrocarbon is recovered in a hot separator and a lighter, lower boiling fraction in a cold separator. These fractions are then combined to provide a product oil.

In the present invention, a diluent modified heavy hydrocarbon such as a diluent modified bitumen (DMH) is added to the product oil.

Typical diluents for modifying the heavy hydrocarbon include naphtha and natural gas condensates. The amount of diluent used to modify the hydrocarbon is preferably no more than an amount sufficient to render the heavy hydrocarbon being modified, pipelineable. Stated differently, the amount of diluent added to the heavy hydrocarbon is no more than that required to provide a DMH having a viscosity at 40° C. that meets pipeline specifications, for example, in the range of about 30 to 60 cSt. Typical ratios (v/v) of heavy hydrocarbon to diluent are in the range of about 80:20 to about 70:30.

The DMH is added to the product oil in an amount sufficient to dissolve phase separated asphaltenes and, in those instances where asphaltene separation is not immediately evident in the product oil, the DMH is added in an amount sufficient to stabilize the product oil against asphaltene phase separation. In the latter instance, experience has shown that asphaltene containing oils that have a toluene equivalency number less than 55 typically will not phase separate the asphaltene. By definition, the asphaltenes in this case are said to be compatible with the bulk oil. Thus sufficient DMH is added to the product oil in that instance to provide such a toluene equivalency number. The method for determining the toluene equivalency number can be found in U.S. Pat. No. 5,871,634 which is incorporated herein by reference.

As a general guideline for both instances described above, the ratio of product oil to DMH (v/v) is in the range of about 75:25 to about 40:60 and preferably 70:30 to 50:50.

For convenience, the hydrocarbon used in forming the diluent modified hydrocarbon (DMH) will be the same type heavy hydrocarbon as that subjected to a mild-hydroconversion, although other heavy hydrocarbons may be modified with diluent and used.

EXAMPLES

Example 1

A bitumen sample from Cold Lake oil sands was subjected to a slurry hydroconversion in a continuous pilot unit at 420° C. using a coke fly ash catalyst. The hydroconversion was conducted for a time sufficient to provide a heavy fraction (recovered in a hot separator) and a lighter fraction (recovered in a cold separator) which were combined to yield a product oil having a viscosity of 19 cSt at 40° C. Asphaltenes separated from this product oil.

A series of mixtures were then generated by blending the product oil with a diluent modified hydrocarbon (DMH). In this example the heavy hydrocarbon was Cold Lake bitumen and the diluent was natural gas condensate. The ratio of heavy hydrocarbon to diluent employed in runs 2 to 6 was 80:20 (v/v).

Table I gives the ratio of product oil to DMH used in each run.

TABLE 1

| Run | 1 | 2 | 3 | 4 | 5 | 6 |
|---|---|---|---|---|---|---|
| Product: DMH[1] (v/v) | 100:0 | 90:10 | 80:20 | 70:30 | 60:40 | 50:50 |
| API gravity at 15° C. | 19.6 | ND[2] | ND | 19.0 | 18.8 | 18.6 |
| Viscosity, cSt at 40° C. | 19 | ND | ND | 40 | 47 | 63 |
| Toluene Equivalence | 90 | ND | ND | 45 | 45 | 25 |
| Compatible | No | No | No | Yes | Yes | Yes |

[1] 80:20 (v/v) DMH; viscosity at 40° C. = 140 cSt
[2] ND = not detennined because not compatible

Example 2

The procedure of Example 1 was repeated except that in these runs the ratio of hydrocarbon to diluent in the DMH was 75:25 (v/v). The results are given in Table 2.

TABLE 2

| Run | 7 | 8 | 9 | 10 | 11 | 12 |
|---|---|---|---|---|---|---|
| Product: DMH[3] (w/w) | 100:0 | 90:10 | 80:20 | 70:30 | 60:40 | 50:50 |
| API gravity at 15° C. | 19.6 | ND[4] | ND | NM[5] | 22.1 | 22.2 |
| Viscosity, cSt at 40° C. | 19.0 | ND | ND | NM | 23 | 25 |
| Toluene Equivalence | 90 | ND | ND | NM | 47 | 42 |
| Compatible | No | No | No | Yes | Yes | Yes |

[3] 75:25 (v/v) DMH; viscosity at 40° C. = 74 cSt
[4] ND = not determined because not compatible
[5] NM = not measured

Example 3

The procedure of Example 1 was repeated using a sample produced under slurry processing conditions in an autoclave. In these runs the ratio of heavy hydrocarbon to diluent used was 70:30 (v/v). The results are given in Table 3.

TABLE 3

| Run | 13 | 14 | 15 | 16 |
|---|---|---|---|---|
| Product: DMH[6] (v/v) | 100:0 | 90:10 | 80:20 | 70:30 |
| API gravity at 15° C. | 17.8 | 18.1 | 18.7 | 19.3 |
| Viscosity, cSt at 40° C. | 43 | 45 | 48 | 62 |
| Toluene Equivalency | 79 | 77 | 57 | 44 |
| Compatible | No | No | No | Yes |

[7] 0:30 (v/v) DMH; viscosity at 40C. = 42 cSt

What is claimed is:

1. A method for rendering a heavy hydrocarbon pipelineable which comprises:

subjecting a heavy hydrocarbon to a mild-hydroconversion process under conditions and for a time sufficient to provide a product oil having a viscosity in the range of 30 to 60 cSt at 40° C. and an API gravity at 15° C. in the range of 17° to 21°;

adding a diluent modified heavy hydrocarbon (DMH) to the product oil in an amount sufficient to stabilize the product oil against asphaltene phase separation and when phase separated asphaltene is present, to dissolve the phase separated asphaltene wherein the amount of diluent used to modify the heavy hydrocarbon is an amount sufficient to provide a DMH with a viscosity at 40° C. in the range of about 30 to 60 cSt and an API gravity of 15° C. of 19° to 21°.

2. The method of claim 1 wherein the DMH has a hydrocarbon to diluent ratio (v/v) in the range of about 80:20 to about 70:30.

3. The method of claim 2 wherein the DMH added to the product oil is sufficient to provide a product oil to DMH (v/v) ratio in the range of about 75:25 to about 40:60.

4. The method of claim 2 wherein the ratio of product oil to DMH (v/v) is in the range of 70:30 to 50:50.

5. A hybrid oil comprising:

a mixture of (i) a product oil obtained from the catalytic hydroconversion of a heavy hydrocarbon, the product oil having a viscosity of 40 to 60 cSt at 40° C. and an API gravity at 15° C. of 17° to 21°; and (ii) a diluent modified heavy hydrocarbon (DMH) wherein the amount of diluent used to modify the heavy hydrocarbon is an amount sufficient to provide the DMH with a viscosity of 40 to 60 cSt at 40° C. and API gravity of 19° to 21°;

wherein the ratio (v/v) of (i) to (ii) is in the range of about 75:25 to about 40:60.

6. The hybrid oil of claim 5 wherein the DMH has a heavy hydrocarbon to diluent ratio (v/v) in the range of about 80:20 to about 70:30.

7. The oil of claim 6 wherein the ratio (v/v) of (i) to (ii) is in the range of 70:30 to 50:50.

* * * * *